United States Patent [19]

van der Kooij

[11] Patent Number: 4,547,951

[45] Date of Patent: Oct. 22, 1985

[54] METHOD FOR FLUSH MOUNTING A WASHING UNIT IN A WORKING LEAF OR THE LIKE AND STRIP TO BE USED WITH THIS METHOD

[76] Inventor: Willem P. van der Kooij, A.van Solmsstraat 1, 2404 GN Alphen a.d.Rijn, Netherlands

[21] Appl. No.: 484,704

[22] Filed: Apr. 13, 1983

[30] Foreign Application Priority Data

Apr. 27, 1982 [NL] Netherlands ..... 8201729

[51] Int. Cl.[4] ..... B23P 11/02

[52] U.S. Cl. ..... 29/450; 29/525; 4/635; 4/636

[58] Field of Search ..... 29/450, 525; 4/635, 4/636, 234, 237

[56] References Cited

U.S. PATENT DOCUMENTS 2,727,248 12/1955 Switzer ..... 4/636 X 3,229,310 1/1966 Rensch ..... 4/636

*Primary Examiner*—Howard N. Goldberg

*Assistant Examiner*—Timothy V. Eley

*Attorney, Agent, or Firm*—Kane, Dalsimer, Kane, Sullivan and Kurucz

[57] ABSTRACT

The invention relates to a method for flush mounting a washing unit in a working leaf or the like and a strip to be used with this method. An opening corresponding to the washing unit (2) is made in the working leaf (1), while the strip (6, 22, 29) is fastened to the working leaf edge which defines this opening so that the upper edge (9) of the strip substantially joins the upper surface (14) of the working leaf (1). The strip in cross-section is substantially U-shaped, wherein the peripheral edge (17) of the washing unit (2) has a thickness greater than the distance between the ends of the legs (11, 12) of the strip. The lower leg (12) of the strip is a relatively rigid carrying flange, while the upper leg (11) is a relatively soft resilient sealing ribbon. The washing unit (2) is positioned with the one surface of its peripheral edge (17) on the one leg of the strip (6, 22, 29) and thereafter the other leg of the strip is applied to the exposed surface of the peripheral edge of the washing unit.

2 Claims, 7 Drawing Figures

METHOD FOR FLUSH MOUNTING A WASHING UNIT IN A WORKING LEAF OR THE LIKE AND STRIP TO BE USED WITH THIS METHOD

BACKGROUND OF THE INVENTION

The invention relates to a method for flush mounting a washing unit in a working leaf or the like wherein an opening corresponding to the washing unit is made in the working leaf and a strip is fastened to the working leaf edge which defines this opening so that the upper edge of the strip substantially joins the upper surface of the working leaf and to a strip to be used with this method.

In a known method of this kind the washing unit that in this case may consist of a washing basin, for example, is fastened against the lower side of the working leaf. The strip in this case only serves for finishing and protecting the working leaf edge defining the opening. The opening herewith commonly is somewhat smaller than the dimension of the washing basin, so that the upright wall of the washing basin is not aligned with the edge of the working leaf. In practice at the location where the washing basin joins the lower side of the working leaf there may be sealing problems so that humidity will attack the material of the working leaf in time. Furthermore dirt may collect here, which is non-hygienic. Further the appearance of a washing basin flush mounted in this manner is not very beautiful

OBJECT OF THE INVENTION

The object of the invention is to create a method of the kind mentioned in the preamble, wherein these disadvantages are avoided in a simple but nevertheless efficient manner.

For this purpose the method of the invention is characterized in that the strip in cross-section is substantially U-shaped and the legs of the strip fastened to the working leaf edge are directed inwardly and the upper leg is a resilient sealing ribbon and the lower leg is a rigid carrying flange and at least the peripheral edge of the washing unit has a thickness greater than the distance between the ends of the legs of the strip and the washing unit is positioned with the one surface of its peripheral edge on the one leg of the strip and thereafter the other leg of the strip is applied to the exposed surface of the peripheral edge of the washing unit.

In this manner the mounting of a washing unit is considerably simplified whereby the strip has a carrying as well as a sealing function. The upper leg of the strip lies sealingly on the upper surface of the mounted washing unit in that at least the thickness of the peripheral edge of the washing unit received in the U-shape is larger than the distance at rest between the ends of the legs of the strip.

According the invention the washing unit from above is pressed along the upper leg of the strip in the opening onto the lower leg of the strip and a pull string for mounting the washing unit is disposed in the corner between the upper leg and the web of the strip and the upper leg of the strip is applied to the upper surface of the washing unit by taking away the pull string from the joining ends of the strip.

As an alternative the strip leg which after positioning of the washing unit is applied to the exposed surface of the peripheral edge of the washing unit forms the one leg of a L-shaped clamp strip, the second leg of which is pressed into a channel of the strip, which channel is enclosed by the web of the strip and a leg integrally formed with this web in substantially parallel relationship therewith, the second leg of the L-shaped clamp strip and a wall of the channel including cooperating locking means.

The invention also provides a strip to be used with the method of the invention and characterized in that the strip in cross-section is substantially U-shaped so as to receive the peripheral edge of a washing unit to be mounted therein and the lower leg of the strip is a relatively rigid carrying flange and the upper leg of the strip is a relatively soft resilient sealing ribbon.

In a simple embodiment the web and the lower leg of the strip consist of a rigid synthetic material and at least the upper leg consists of a relatively soft resilient synthetic material.

Hereby the strip can be simply fabricated, for example by extrusion in one piece.

Preferably the strip is characterized in that at least that portion of the strip web part formed by the upper leg extension which portion in the mounted position of the strip joins the upper surface of the working leaf also consists of relatively soft resilient material. In this manner also a very good sealing is obtained between the strip and the upper surface of the working leaf in that with the washing unit mounted the soft resilient material of the upper leg of the strip and the said portion of the web of the strip are sealingly pressed against the edge of the working leaf and against the upper surface of the washing unit.

This sealing can further be improved in that the strip web portion consisting of relatively soft synthetic material at the side opposed from the upper leg projects obliquely outwardly with respect to the remaining portion of the strip web.

In a favourable embodiment of the strip of the invention one of the strip legs forms the first leg of a clamp strip of substantially L-shaped cross-section, the second leg of which may be received into a channel that is enclosed between the strip web and a leg integrally formed with this web in parallel relationship thereto, the second leg of the clamp strip and a wall of the channel including cooperative locking means. The mounting of the washing unit is thereby particularly simplified.

It is noted that the method and the strip of the invention are not only adapted for mounting a washing unit but also for mounting a cooking unit or the like. Thus, washing unit also comprises a cooking unit or like units to be mounted in a working leaf.

The method will hereinafter be explained by way of the drawing illustrating some embodiments of the strip of the invention.

DETAILED DESCRIPTION OF THE PREFERRED EMBODIMENTS

Figure 1:
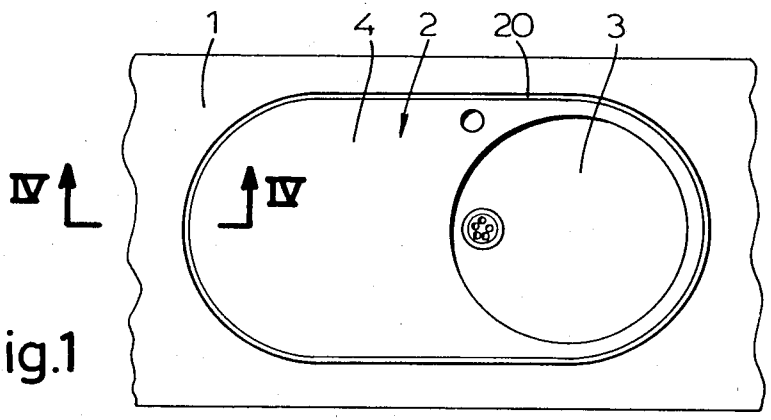
FIG 1 is a fragmentary plan view of a working leaf wherein a washing unit is flush mounted.

FIG. 1 partially shows a plan view of a working leaf 1, wherein a washing unit 2 is flush mounted. The washing unit 2 consists in the embodiment shown in the drawing of a washing basin 3 and a working surface 4. The washing unit 2 is mounted in the working leaf 1 in that an opening corresponding to the washing unit is made in the working leaf whereafter a strip 6 is fastened to the edge 5 of the working leaf 1, said edge defining the opening obtained as illustrated in FIG. 2.

For this purpose, in the edge 5 of the working leaf 1 a slot 7 is milled into which a fastening ribbon 8 is pressed which projects from the strip 6. The upper edge 9 of the strip 6 herein joins the upper layer 10 of the working leaf 1, which upper layer consists of a synthetic material, for example. Before applying the strip 6 the edge 5 of the working leaf 1 can be coated in a usual manner with a protective agent.

Figure 2:
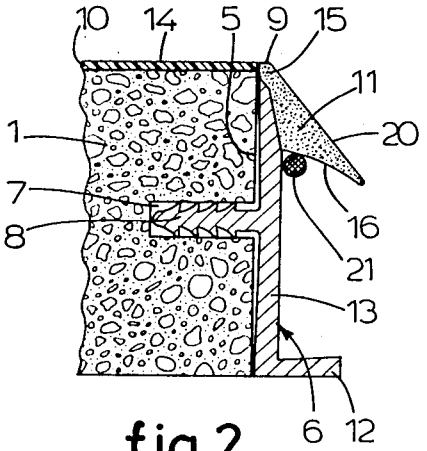
FIG. 2 is a fragmentary cross-section of a first embodiment of the strip of the invention mounted in an opening of a working leaf.
Figure 3:
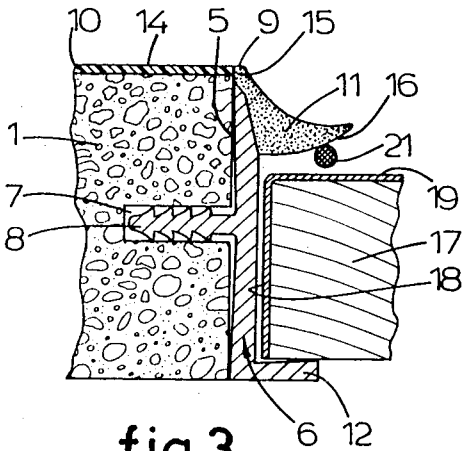
FIG. 3 is a cross-section similar to FIG. 2 and showing the peripheral edge of the washing unit during removal of the pull string.
Figure 4:
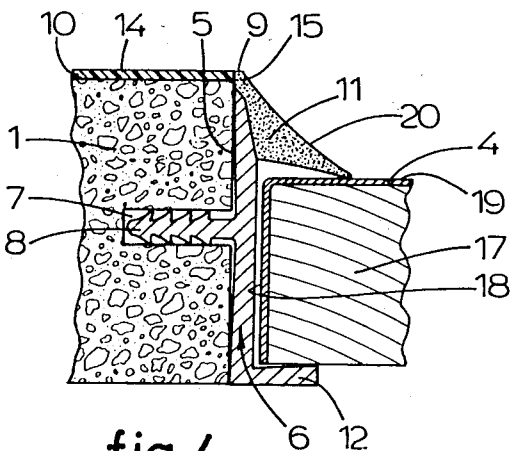
FIG. 4 is a cross-section along the line IV—IV in FIG. 1 and also shows the peripheral edge of the washing units, the pull string being entirely removed.

As appears from FIG. 2, 3 and 4 the strip in cross-section is substantially U-shaped, the legs 11, 12 of the mounted strip 6 being directed inwardly. The lower leg 12, the major portion of the web 13 and the fastening ribbon 8 of the strip are made of a rigid synthetic material, while the upper strip leg 11 of substantially triangular cross-section is made of a relatively soft resilient synthetic material as well as the portion 15 of the web 13 of the strip 6 formed by the extension of the upper leg 11, said portion 15 joining the upper surface 14 of the working leaf 1.

The triangle side 16 of the upper strip leg 11, which side joins the web 13 of the strip 6, is directed at an acute angle with the web 13 towards the lower leg 12, so that the opening enclosed by the ends of the legs 11 and 12 is smaller than the thickness of the peripheral edge 17 of the washing unit shown in FIG. 3.

After the strip 6 is fastened on the edge 5 of the working leaf 1 by pressing the fastening ribbon 8 into the slot 7, the washing unit 2 is pressed from above along the resilient upper leg 11 of the strip 6 in the opening formed in the working leaf 1 until the peripheral edge 17 of the washing unit lies on the lower leg 12 of the strip 6. Thereafter the leg 11 which is now clamped between the outer side 18 of the washing unit 2 and the web 13 of the strip 6, is applied on the upper surface 19 of the washing unit 2, resulting in the situation shown in FIG. 4. Because the opening between the ends of the legs 11, 12 of the strip is smaller than the thickness of the peripheral edge 17 of the washing unit 2, the end of the leg 11 now sealingly engages the upper surface of the washing unit 2, while the portion 15 of the web 13 of the strip is sealingly pressed against the upper layer 10 of the working leaf 1. This effects in a particularly simple manner a sufficient sealing while the visible triangle side 20 forms a smooth transition of the upper surface 14 of the working leaf 1 to the upper surface 19 of the washing unit 2, whereby the working leaf with the flush mounted washing unit 2 shows a beautiful and aesthetical appearance.

The leg 11 of the strip 6 can be applied on the upper surface 19 of the washing unit 2 in a simple manner, because a pull string 21 is disposed in the corner between the upper leg 11 and the web 13 of the strip 6. The pull string after mounting of the washing unit 2 is pulled away from the joining ends of the strip 6, whereby the upper leg 11 of the strip 6 is withdrawn between the outer side 18 of the washing unit 2 and the web 13 of the strip 6 so as to be applied on the upper surface 19 of the washing unit 2 as appears from FIG. 3 and 4.

As is shown in FIG. 2, 3 and 4, the surface of the web 13 at the side of the fastening ribbon 8 is somewhat tapered from the side edges of the strip 6 in the direction of the fastening ribbon 8, whereby the side edges of the mounted strip 6 are tightly applied against the edge 5 of the working leaf 1. This further enhances the sealing between the portion 15 of the strip 6 and the upper layer 10 of the working leaf 1.

Figure 6:
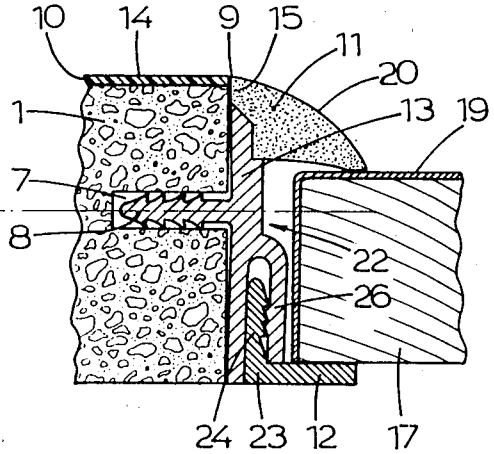
FIG. 6 is a fragmentary cross-section of the strip of FIG. 5 in an assembled condition showing the peripheral edge of the washing unit.
Figure 5:
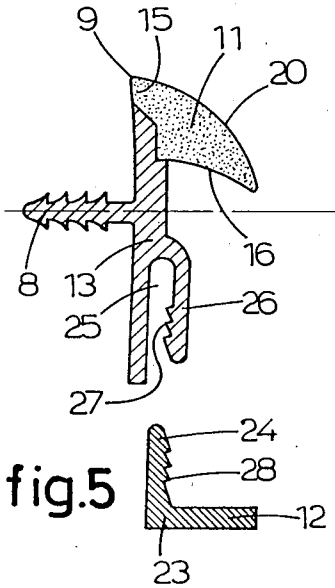
FIG. 5 is a cross-section of a second embodiment of the strip of the invention in disassembled condition.

FIG. 5 and 6 show a second embodiment of a strip adapted for mounting the washing unit 2 and designated by 22. The strip 22 for its major part is similar to the previously described strip 6, whereby similar items have been designated by the same reference numerals. In the strip 22 the lower leg 12 acting as a carrying flange for the peripheral edge 17 of the washing unit 2 forms the first leg of a clamp strip 23 L-shaped in cross-section. The clamp strip 23 includes a second leg 24 that can be pressed into a channel 25 of the strip 22. The channel 25 is enclosed between the web 13 of the strip 22 and a leg 26 integrally formed on this web 13 in parallel relationship thereto.

The mounting of the washing unit 2 when using the strip 22 is particularly simple. The strip is pressed with the fastening ribbon 8 into the slot 7 in the manner described herein above. Thereafter the washing unit 2 is positioned with the surface 19 of the peripheral edge 17 on the leg 11 of the strip 22, and thereafter the clamp strip 23 is pressed into the channel 25 so that the peripheral edge 17 is clamped between the legs 11 and 12 of the strip 22. The side of the leg 26 adjacent the channel 25 and the adjacent side of the leg 24 of the clamp strip 23 include a complementary serration 27, 28, whereby the clamp strip is locked in the channel 25.

Also in this embodiment a good sealing is effected in a particularly simple manner between the strip 22 and the working leaf 1, resp. the surface 19 of the washing unit 2. The sealing between the portion 15 of the strip 22 and the upper layer 10 of the working leaf 1 herein is further improved in that this portion 15 at the side of the fastening ribbon 8 projects outwardly with respect to the remaining portion of the web 13 of the strip 22. Thereby the part of the portion adjacent the upper layer 10 in the mounted condition of FIG. 6 is forcibly pressed against the upper layer 10 of of the working leaf 1.

Figure 7:
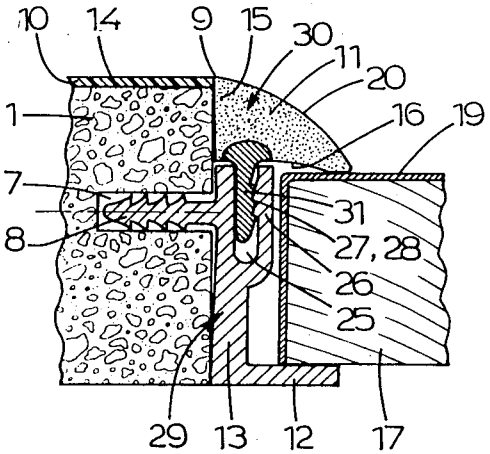
FIG. 7 is a cross-section similar to FIG. 6 and showing a third embodiment of the strip of the invention in the assembled condition.

FIG. 7 shows a strip 29, which is mainly similar to the strip 22 of FIG. 5 and 6, the corresponding items having being designated by the same reference numerals. In the strip 29 the leg 11 forms the one leg of a clamp strip 30 of L-shaped cross-section. The second leg of the clamp strip 30 consists of a ribbon 31 that is anchored in the relatively soft resilient material of the leg 11. The channel 25 in this case is formed at the upper side of the strip 29 and in the same manner as in the strip 22 is defined by the web 13 of the strip 29 and a leg 26 integrally formed thereon in parallel relationship thereto. The leg 26 and the ribbon 31 include a complementary serration 27, 28, whereby the clamp strip 30 is locked in the condition shown in FIG. 7.

The strip 29 of FIG. 7 is particularly adapted for mounting a washing unit in an existing working leaf 1, which could raise problems when using the strip 22 in connection with working from the lower side as necessitated thereby.

The invention is not limited to the embodiments described above, which can be varied within the scope of the invention in various manners.

I claim:

1. A method for flush mounting a washing unit in a counter top or the like comprising the following steps:

providing a strip adapted to be insertably secured to the counter top, the strip having a fastening ribbon member for insertion into the counter top, a web portion, and an upper leg composed of a resilient material; inserting the fastening ribbon into the counter top thereby securing the strip to the counter top; placing a peripheral edge of the washing unit adjacent to the web of the strip and below the upper leg of the strip;

providing an inverted U-shaped portion on one end of the strip having ridges on an internal portion thereof; providing an L-shaped lower leg having ridges on an outer portion thereof; inserting the L-shaped lower leg into the U-shaped lower portion so that te ridges engage and so that the distance between the legs at the point of contact with the washing unit is less than the cross-sectional size of the portion of the washing unit secured therebetween, wherein a watertight seal is provided by the upper leg.

2. A method for flush mounting a washing unit in a counter top or the like comprising the following steps:

providing a strip adapted to be insertably secured to a counter top, the strip having a fastening ribbon member for insertion into the counter top, a web portion, and a lower leg composed of a rigid material; inserting the fastening ribbon into the counter top thereby securing the strip to the counter top; placing a peripheral edge of the washing unit adjacent to the web of the strip and above the lower leg of the strip; providing a U-shaped portion on an upper end of the strip having ridges on an internal portion thereof; providing an upper leg having a first part with ridges on an outer portion thereof and a second part of resilient material; coupling the first part of the upper leg with the U-shaped upper portion so that the ridges engage and so that the distance between the legs at the point of contact with the washing unit is less than the cross-sectional size of the portion of the washing unit secured therebetween, wherein a watertight seal is provided by the resilient material of the upper leg portion.

* * * * *